US009775443B2

(12) United States Patent
Spahn et al.

(10) Patent No.: US 9,775,443 B2
(45) Date of Patent: Oct. 3, 2017

(54) DISCONTINUOUS AIR DELIVERY SYSTEM FOR INFLATABLE STATIC MEDICAL DEVICE

(71) Applicant: EHOB, Inc., Indianapolis, IN (US)

(72) Inventors: James G Spahn, Indianapolis, IN (US); Jeffrey A. Day, Carmel, IN (US); Haiyang Chen, Indianapolis (CN)

(73) Assignee: EHOB, Inc., Indianapolis, IN (US)

( * ) Notice: Subject to any disclaimer, the term of this patent is extended or adjusted under 35 U.S.C. 154(b) by 143 days.

(21) Appl. No.: 14/549,275

(22) Filed: Nov. 20, 2014

(65) Prior Publication Data

US 2015/0135444 A1 May 21, 2015

Related U.S. Application Data

(60) Provisional application No. 61/906,608, filed on Nov. 20, 2013.

(51) Int. Cl.

| | |
|---|---|
| ***A47C 27/08*** | (2006.01) |
| ***A47C 7/02*** | (2006.01) |
| ***A61G 7/057*** | (2006.01) |
| *A61G 5/10* | (2006.01) |

(52) U.S. Cl.

CPC ..... *A47C 27/083* (2013.01); *A47C 7/021* (2013.01); *A61G 7/05769* (2013.01); *A61G 5/1043* (2013.01)

(58) Field of Classification Search

CPC ..... A47C 27/08
USPC ..... 5/710, 713, 706, 655.3
See application file for complete search history.

(56) References Cited

U.S. PATENT DOCUMENTS

| | | | | |
|---|---|---|---|---|
| 4,788,729 | A | 12/1988 | Walker | |
| 5,729,853 | A | 3/1998 | Thompson | |
| 5,848,450 | A * | 12/1998 | Oexman | A47C 27/082 5/706 |
| 6,483,264 | B1 | 11/2002 | Shafer et al. | |
| 2009/0314354 | A1 | 12/2009 | Chaffee | |
| 2010/0180678 | A1 | 7/2010 | Casner | |
| 2010/0212089 | A1 | 8/2010 | Kajiwara et al. | |
| 2012/0017376 | A1 | 1/2012 | Mikkelsen et al. | |

(Continued)

OTHER PUBLICATIONS

PCT Application No. PCT/US2014/066682 "International Search Report and Written Opinion" mailing date Mar. 3, 2015.

*Primary Examiner* — Fredrick Conley
(74) *Attorney, Agent, or Firm* — Carson Boxberger, LLP

(57) ABSTRACT

An air delivery system that includes an inflatable cushion device adapted to support at least a portion of a body of a user. The air delivery device includes a supply conduit in fluid communication with both an interior region of the inflatable cushion device and a controller. Using a pressure sensor, the controller is adapted to relatively continuously measure a static air pressure level of the interior region and compare the measured static air pressure level to a target air pressure level. Further, the controller is adapted to intermittently operate an air pump. Moreover, the controller may operate the air pump when measured static air pressure is below the target static air pressure level, and deactivate operation of the air pump, which may include maintaining the air pump in an un-operated condition when the measured static air pressure is within the target static air pressure level.

18 Claims, 4 Drawing Sheets

(56) References Cited

U.S. PATENT DOCUMENTS

| | | | |
|---|---|---|---|
| 2012/0090698 | A1 | 4/2012 | Giori et al. |
| 2013/0031725 | A1 | 2/2013 | Riley et al. |

* cited by examiner

DISCONTINUOUS AIR DELIVERY SYSTEM FOR INFLATABLE STATIC MEDICAL DEVICE

CROSS REFERENCE TO RELATED APPLICATIONS

The present application claims the benefit of U.S. Provisional Patent Application Ser. No. 61/906,608 flied Nov. 20, 2013, the contents of which are incorporated herein by reference in their entirety.

BACKGROUND

Embodiments of the present invention generally relate to air delivery systems for static air cushion devices. More particularly, embodiments of the present invention relate to an air delivery system that intermittently operates an air pump or motor to deliver air to an inflatable cushion device while relatively continuously measuring a pressure corresponding to static air pressure within the inflatable cushion device.

The number of incidences of patients suffering from pressure ulcers reportedly continues to rise. For example, annually, approximately 2.5 million patients are treated in acute-care facilities for pressure ulcers. Dorner, B., Posthauer, M E & Thomas, D., The Role of Nutrition in Pressure Ulcer Prevention and Treatment: National Pressure Ulcer Advisory Panel White Paper, National Pressure Ulcer Advisory Panel (NPUAP) (2009), http://www.npuap.org/Nutrition%20White%20Paper%20Website%20Version.pdf. Caregivers therefore continue to seek to identify effective practices for addressing pressure ulcers, including steps for preventing and treating such ulcers.

Patients with pressure ulcers are often three times more likely to be discharged to a long-term care facility than those patients who do not suffer from pressure ulcers. Id. Further, pressure ulcers are more likely to occur among those over the age of 65 years. Thus, as the U.S. population aged 65 and older is expected to double within the next 25 years, the risk for, and subsequent prevalence of, pressure ulcers are expected to increase. Russo, C. A., Steiner, C., & Spector, W. *Hospitalizations Related to Pressure Ulcers among Adults 18 Years and Older* (2006) http://www.hcup-us.ahrq.gov. Additionally, people typically become frailer as they age. Because frailty and pressure ulcers share important risk factors such as, for example, incontinence, falls, delirium and functional decline, the anticipated increase in the size of the elderly population, and the associated frailness associated with the elderly, may add to the growing concern of pressure ulcer risk in the aging baby boomer population. Campbell, K., A *New Model to Identify Shared Risk Factors for Pressure Ulcers and Frailty in Older Adults*, Rehabilitation Nursing 34.6 at 242-47 (2009). Therefore, if proactive assessments, prevention, and/or early intervention are not implemented for the growing, high risk geriatric population, pressure ulcers could adversely impact the quality of health care delivered and the associated, and already worrisome, financial burdens. Sibbald, R., Krasner, D. & Woo, K L, *Pressure Ulcer Staging Revisited: Superficial Skin Changes & Deep Pressure Ulcer Framework*, Advances in Skin & Wound Care, 24.12 at 571-80 (2011). For example, the average cost associated with the treatment of Stage IV pressure ulcers has been reported as $129,248. Brem, H., Maggi, J., et al., *High Cost of Stage IV Pressure Ulcers*, The American Journal of Surgery, 200.4 at 473-77 (2010).

Since pressure ulcer prevention, early intervention, treatment and care has become a quality indicator used by federal/state agencies for regulatory oversight and litigation proceedings, avoidance of pressure ulcer related problems typically should occur by caregivers at multiple levels of care delivery. Vermette, S., Reeves, I. & Lemaire, J., *Cost Effectiveness of an Air-inflated Static Overlay for Pressure Ulcer Prevention: A Randomize, Controlled Trial*, Wounds, 24.8 at 207-14 (2012). For example, federal/financial fines for non-compliance with regulatory requirements associated with pressure ulcers may cost around $3,050 to $10,000 per day for development of avoidable Stage IV pressure ulcers. Brem, H., Maggi, J., et al., *High Cost of Stage IV Pressure Ulcers*, The American Journal of Surgery, 200.4 at 473-77 (2010). Further, the number of long-term legal cases related to pressure ulcers has increased from an average of 7 cases per year between 1984 and Aug. 31, 1999, to an average of 18 cases per year between September 1999 and 2010. Id. Further, recovery costs for parties in such cases also reportedly increased 403% from $3,359,259 in 1999 to $13,554,168 in 2002. Additionally, an apparent trend in verdicts being rendered in plaintiffs' favor may suggest that healthcare facilities are being held to a higher standard of care. Brem, H., Maggi, J., et al., *High Cost of Stage IV Pressure Ulcers*, The American Journal of Surgery, 200.4 at 473-77 (2010).

When the deep tissue injury component is considered in pressure ulcer staging, heel pressure ulcers are now first in occurrence. VanGilder, C., MacFarlane, G., Harrison, P., Lachenbruch, C., & Meyer, S., *The Demographics of Suspected Deep Tissue Injury in the United States: An Analysis of the International Pressure Ulcer Prevalence Survey*, Advances in Skin & Wound Care 23.6 at 254-61 (2010). Further, typically support surfaces do not protect the ankle/foot/heel from pressure ulcers at all times. For example, recumbent physiological changes, hemodynamics (decreased circulatory perfusion and venous congestion), and the anatomy (multiple bony prominences with minimal subcutaneous tissue attached to the legs which acts as a fulcrum) of the region may create unique and challenging needs that frequently exceeds the capabilities of a support surface to protect the ankle/foot/heel from mechanical stress injury. Further, support structures, particularly those addressing the ankle/foot/heel, may need to at least attempt to satisfy certain criteria such as, for example, elevate the heel (off of an adjacent surface), protect the sides of the foot and ankle, neutralize weight of lower extremity, maintain and promote circulation, address foot drop and lateral rotation of ankle, allow access to the foot for inspection/treatment, facilitate the musculoskeletal pump, minimize the risk for product contamination of surface or media, and/or be easy to clean. Additionally, such products may need to comply with regulatory requirements such as, for example, be flame retardant, biocompatible, and antimicrobial, as well as comply with FDA regulations and certain manufacturing processes such as, for example, ISO requirements. However, such support products may need to address a variety of other criteria, including, but not limited to, being lightweight, pliable yet durable, and being latex free.

BRIEF SUMMARY

An aspect of the present invention is a method for maintaining a static air pressure level within an interior region of an inflatable cushion device. The method includes selecting a target static pressure level based on at least one physical characteristic of a user of the inflatable cushion device and setting a controller to operate an air pump to attain the selected target static air pressure level in the interior region of the inflatable cushion device. Further, static air pressure that indicates the static air pressure level within the interior region is relatively continuously measured and while the inflatable cushion device is positioned about or beneath at least a portion of the user. Additionally, the controller activates operation of the air pump to supply an airflow from the air pump for the interior region in response to measured static air pressure being below the selected target static air pressure level. The method also includes deactivating, by the controller, operation of the air pump when measured static air pressure is not below the selected target static air pressure level.

Another aspect of the present invention is a method for maintaining a static air pressure level in an interior region of an inflatable cushion device. The method includes measuring, relatively continuously and while the inflatable cushion device is positioned about or underneath at least a portion of a user, a static air pressure that corresponds to the static air pressure level in the interior region and determining, by a controller having a processing device, whether the measured static air pressure is above or below a target static air pressure level. The method further includes delaying, for a predetermined time period, activation of an air pump when the measured static air pressure is below the target static air pressure level, the air pump being adapted to provide a supply of airflow for delivery to the interior region. The controller further determines whether static air pressure measured during the predetermined time period is within the target static air pressure level and activates, upon expiration of the predetermined time period, the air pump if the static air pressure measured during the predetermined time period remained below the target static air pressure level. The controller further maintains the air pump in a deactivated mode when measured static air pressure is within the target static air pressure level.

Another aspect of the present invention is an air delivery system that includes an inflatable cushion device adapted to support at least a portion of a body of a user. The air delivery device also includes a supply conduit that has a first end, a second end, a first inner passageway, and a second inner passageway. The second end of the supply conduit is operably connected to the inflatable cushion device, while the first and second inner passageways are in fluid communication with an interior region of the inflatable cushion device. The air delivery system also includes a controller having a pressure sensor and an air pump. The first end of the supply conduit is operably connected to the controller, with the first inner passageway being in fluid communication with the air pump and the second inner passageway being in fluid communication with the pressure sensor. The controller is adapted to, through use of the pressure sensor when the inflatable cushion device is operably positioned to support at least a portion of the user, relatively continuously measure a static air pressure of air received in the second inner passageway from the interior region. Additionally, the controller is adapted to activate the air pump to supply an airflow through the first inner passageway of the supply conduit for the interior region of the inflatable cushion device when the static air pressure measured by the controller is below a target static air pressure level. The controller is also adapted to deactivate operation of the air pump when the static air pressure measured by the controller is within the target static air pressure level.

Other aspects of the present invention will become apparent by consideration of the detailed description and accompanying drawings.

Figure 1:
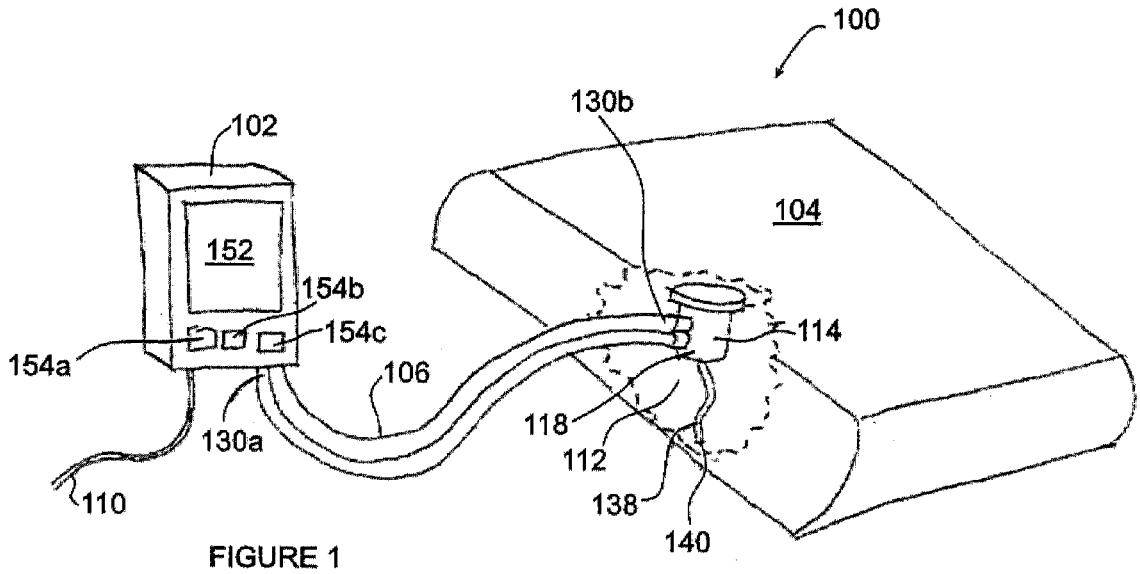
FIG. 1 illustrates a perspective view of an air delivery system according to an illustrated embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DESCRIPTION OF THE ILLUSTRATED EMBODIMENTS

FIG. 1 illustrates a perspective view of an air delivery system 100 according to an illustrated embodiment of the present invention. The air delivery system 100 may include a controller 102 in fluid communication with an inflatable cushion device 104 such as, for example, via a supply conduit 106. According to certain embodiments, a rear side of the controller 102 may be configured for operable attachment to a support structure such as, for example, a bed hanger bracket, bed frame, rail, or post, among other support structures. According to certain embodiments, the rear side of the controller 102 has one or more grooves, slots, or orifices that are configured to mate with the support structure to operably secure the controller 102 to the support structure. Alternatively, according to other embodiments, one or more straps may extend from the backside of the controller 102 that are adapted to operably connect the controller 102 to a support structure. The straps may include a connector such as, for example, hook and/or loop material, or a buckle and/or snap, among other connectors, that may assist in securing the controller to the support structure.

Although the controller 102 and the inflatable cushion device 104 are illustrated in FIG. 1 as separate components, according to other embodiments, the controller 102 may be part of the inflatable cushion device 104. Further, as shown in at least FIG. 3, according to the illustrated embodiment, the controller 102 may include, or be operably connected to, an air pump or motor 108. According to certain embodiments, the air pump or motor 108 may be an electrical air pump. As discussed below, the controller 102 may be adapted to control operation of the air pump or motor 108 so as to control the inflation of, and/or the static air pressure within, the inflatable cushion device 104.

The controller 102 may be provided with electrical power in a variety of different manners, including, for example, through a power line or cord 110 operably connected to a power supply, through the use of an internal battery, or a combination thereof, among other manners of powering the controller 102. For example, according to certain embodiments, the controller 102 may be configured to operate using either direct current (DC) or alternating current (AC). Further, in the event of an AC power failure, the controller 102 may be adapted to be operated using DC power. Additionally, the controller 102 may be powered by electrical power delivered to the controller 102 via one or more internal power sources such as, for example, batteries. According to certain embodiments, the internal power source may provide back-up power for the controller 102 in the event electrical power is not being delivered to the controller 102 via the power line or cord 110.

The inflatable cushion device 104 may have a variety of different forms and/or uses. For example, according to certain embodiments, the inflatable cushion device 104 may be an air mattress or pad adapted to be positioned beneath the body of a user. Moreover, according to certain embodiments, the inflatable cushion device may be a static air inflatable medical cushion device such as, for example, an inflatable cushion device adapted to prevent or facilitate recovery from pressure ulcers. According to other embodiments, the inflatable cushion device 104 may be configured to be positioned beneath or around a portion of a patient, such as beneath and/or around the leg, ankle, and/or foot region of the patient. Additionally, the inflatable cushion device 104 may have a variety of different types of construction, including, but not limited to, having a single chamber inflatable bladder construction.

Figure 2:
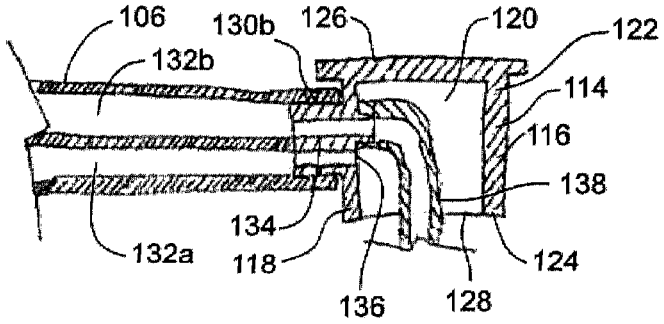
FIG. 2 illustrates a cross sectional view of a discharge device according to an illustrated embodiment of the present invention.
Figure 3:
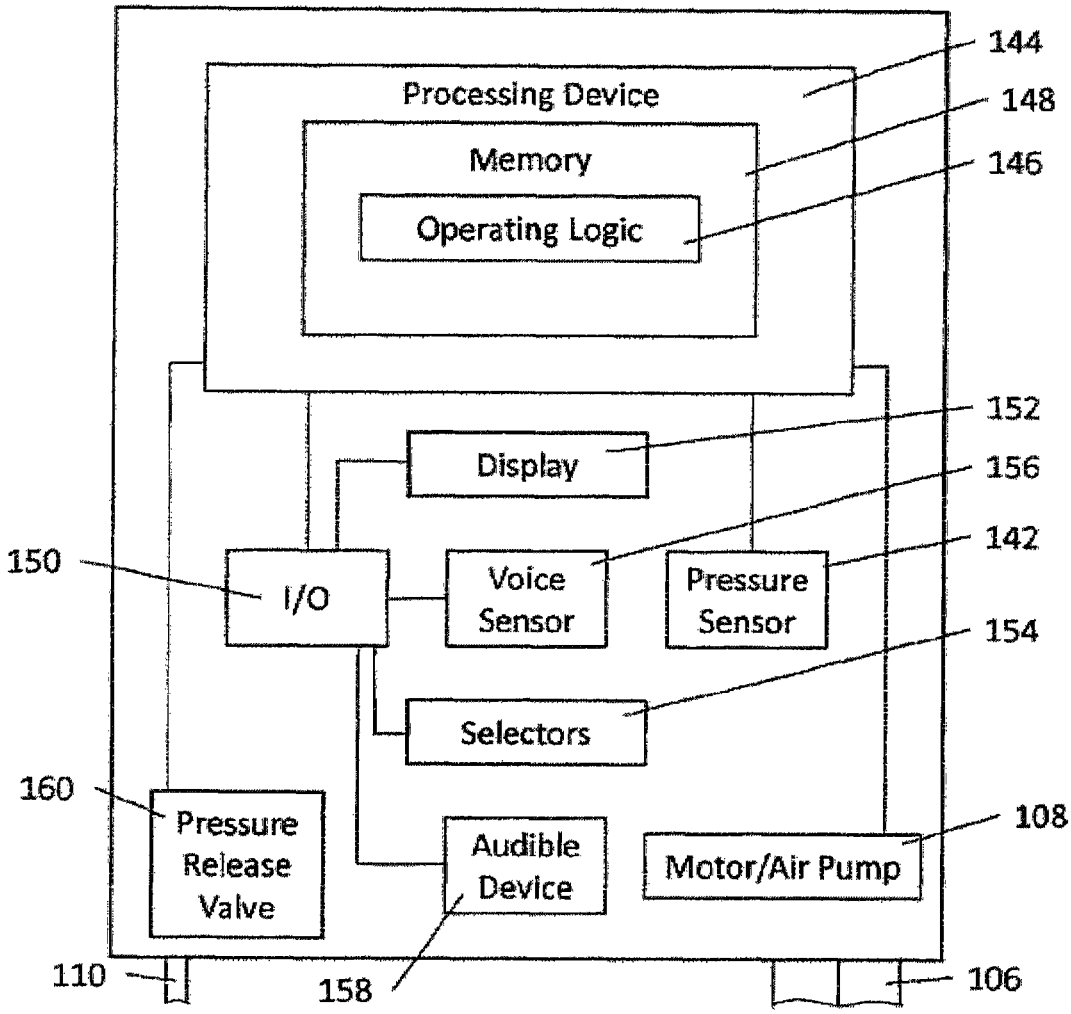
FIG. 3 is a schematic diagram of an exemplary controller for an air delivery system according to an illustrated embodiment of the present invention.

Referencing FIGS. 1-3, air from the controller 102 and/or the air pump or motor 108 controlled by the controller 102 may be released into an interior region 112 of the inflatable cushion device 104 through a discharge device 114. Moreover, according to the illustrated embodiment, air delivered from the air pump or motor 108 via operation of the controller 102 may be delivered through at least a portion of the supply conduit 106 to the discharge device 114, and subsequently discharged from the discharge device 114 into the interior region 112 of the inflatable cushion device 104. The discharge device 114 may have a variety of different configurations. For example, according to the illustrated embodiment, the discharge device 114 may include a body portion 116 having a wall 118 that generally defines an inner area 120 of the discharge device 114. The discharge device 114 may also include a proximal end 122 and a distal end 124. According to certain embodiments, the proximal end 122 may be configured to operably secure the discharge device 114 to the inflatable cushion device 104. For example, referencing FIG. 2, according to the illustrated embodiment, the proximal end 122 of the discharge device 114 may include a cap 126 sized to engage, or otherwise be positioned within, a recess in the inflatable cushion device 104 so as to secure the discharge device 114 to the inflatable cushion device 104. However, the discharge device 114 may be connected to the inflatable cushion device 104 in a variety of other manners. The distal end 124 of the discharge device 114 may include an aperture 128 configured to allow the inner area 120 of the discharge device 114 to be in fluid communication with the interior region 112 of the inflatable cushion device 104.

The supply conduit 106 may be a non-crimping and relatively flexible, semi-rigid, or rigid tube or pipe that has opposing first and second ends 130*a*, 130*b* and one or more inner passageways 132*a*, 132*b*. The first end 130*a* may be operably coupled to the controller 102 such as, for example, to a connection member of the controller 102, including, but not limited to, one or more fittings, posts, protrusions, or recesses, among other types of connections. According to certain embodiments, the controller 102 may have a recessed area sized to mate with at least a portion of the first end 130*a* of the supply conduit 106 such as, for example, a generally rectangular shaped recess that securely receives insertion of at least a portion of a similarly generally rectangular shaped portion of the first end 130*a* of the supply conduit 106. Further, according to certain embodiments, the controller 102 may include one or more pipe inlet nipples that is/are received in a portion of a corresponding first inner passageway 132*a* of the supply conduit 106.

The second end 130*b* of the supply conduit 106 is operably connected to the discharge device 114. For example, according to the illustrated embodiment, the second end 130*b* of the supply conduit 106 may securely engage-one or more connection members or fittings 134 of the discharge device 114. A variety of different types and configurations of connection members or fittings 134 may be employed to secure the second end 130*b* to the discharge device 114, including, for example, one or more protrusions that extend from a body portion 116 of the discharge device 114.

At least one inner passageway 132*a*, 132*b* of the supply conduit 106 is adapted to deliver a flow or supply of air between the controller 102 and the inflatable cushion device 104. According to certain embodiments, air delivered through the first inner passageway 132*a* to the discharge device 114 may be discharged from the discharge device 114 through a discharge outlet 136. In the illustrated embodiment, the discharge outlet 136 is positioned in an inner area 120 of the body portion 116 of the discharge device 114. The discharged air may then flow from the inner area 120 through the aperture 128 and into the interior region 112 of the inflatable cushion device 104. The discharge outlet 136 may be positioned at a variety of other locations. For example, according to certain embodiments, the discharge device 114 may include a discharge tube or line that extends away from the body portion 116 so that the air delivered through the first inner passageway 132*a* is released into the interior region 112 of the inflatable cushion device 104 at a location remote from the body portion 116.

According to certain embodiments, the supply conduit 106 may also have a second inner passageway 132*b* that may receive air from an interior region 112 of the inflatable cushion device 104. Referencing FIGS. 1 and 3, the second inner passageway 132*b* may be in fluid communication with a pressure sensor 142 that is part of, or operably coupled to, the controller 102. The pressure sensor 142 may utilize air in at least the second inner passageway 132*b* to sense, or otherwise provide an indication of, a static air pressure in the inflatable cushion device 104. As shown in FIG. 2, according to certain embodiments, the second inner passageway 132*b* may be in fluid communication with a gage line 138 that extends away from at least the body portion 116 of the discharge device 114. Referring to FIG. 1, a gage inlet 140 of the gage line 138 may be adapted to allow for the passage of air between an inner portion of the gage line 138 and the interior region 112 of the inflatable cushion device 104 as the static air pressure changes. Moreover, such passage of air between the gage line 138 and the interior region 112 may alter the amount, and thus the pressure, of air in the second inner passageway 132*b*, thereby altering the static air pressure sensed by the pressure sensor 142. Additionally, according to the illustrated embodiment, the gage inlet 140 may be positioned at a location remote from the discharge outlet 136 so that airflow being discharged from the discharge outlet 136 does not alter the flow of air into, or out of the gage inlet 140 in a manner that may adversely impact the air pressure sensed by the pressure sensor 142. For example, according to certain embodiments, the gage line may be approximately 7 inches in length, which may allow the gage inlet 140 to be positioned at a location remote from at least the discharge outlet 136. Further, according to certain embodiments, the pressure sensor 142 may be positioned at a variety of locations other than the controller 102. For example, according to certain embodiments, the pressure sensor 142 may be connected to the gage line 138, the discharge device 114, and/or the supply conduit 106. According to such embodiments, at least a portion of the second inner passageway 132*b* may be adapted for the passage of one or more electrical wires or leads that are used in the delivery of an electric signal from the pressure sensor 142 to the controller 102 that is indicative of the static air pressure sensed by the pressure sensor 142.

Additionally, although the depicted air delivery system 100 is illustrated and described herein as having the controller 102 operably connected to a single inflatable cushion device 104, according to certain embodiments, the controller 102 may be adapted to inflate and/or measure and maintain a static air pressure of, more than one inflatable cushion device 104. Moreover, according to certain embodiments, the controller 102 may be operably connected to more than one supply conduit 106, with each supply conduit adapted to provide air to an inflatable cushion device 104, or a different portion of a single inflatable cushion device 104, as well as be adapted to at least assist in the controller 102 being used in connection with the sensing or measuring of the static air pressure within an interior region 112 of the associated inflatable cushion devices 104.

FIG. 3 is a schematic diagram of an exemplary controller 102 for the air delivery system 100 according to an illustrated embodiment of the present invention. As shown, the controller 102 may include one or more different processing devices 144 such as, for example, programmable, dedicated, and/or hardwired state machine types of processors, as well as any combination thereof. The processing device 144 may further include multiple processors such as, for example, Arithmetic-Logic Units (ALUs), Central Processing Units (CPUs), Digital Signal Processors (DSPs), or the like. Processing devices 144 with multiple processing units may also utilize distributed, pipelined, and/or parallel processing. The processing device 144 may also be dedicated to performance of just the operations described herein or may be utilized in one or more additional applications. For example, according to certain embodiments, the processing device 144 may include multiple processors and may be of a programmable variety that executes algorithms and processes data in accordance with an operating logic 146 as defined by programming instructions (such as software or firmware) stored in a memory 148.

The memory 148 may or may not be part of the processing device 144. Further, the memory 148 may be of one or more types, such as a solid-state variety, electromagnetic variety, optical variety, or a combination of these forms. Additionally, the memory 148 can be volatile, nonvolatile, or a combination of these types, and some or all of the memory 148 can be of a portable variety, such as a disk, tape, memory stick, cartridge, or the like. In addition, according to certain embodiments, the memory 148 can store data that is manipulated by the operating logic 146 of processing device 144, such as data representative of signals received from and/or sent to one or more input/output devices 150, in addition to, or in lieu of, storing programming instructions defining the operating logic 146.

The processing device 144 may also include one or more components of any type suitable to process signals received from an input/output devices 150 of the controller 102 such as, for example, signals from one or more selectors 154 such as, but not limited to, a push button, switch, keypad, and/or touch screen, and to provide desired output signals to output devices such as, for example, a display or monitor 152. Further, according to certain embodiments, operation of the controller 102 may be controlled through a wired or wireless connection to another processor device. For example, as discussed below, according to certain embodiments, the controller 102 may include a transceiver that may allow the controller 102 to receive communications from portable devices, including smart phones, that may allow commands to be received by the controller 102 that may alter the operation of the controller 102, and thereby adjust an air pressure level in the inflatable cushion device 104.

As shown in FIGS. 1 and 3, according to the illustrated embodiment, the selector 154 of the controller 102 may include three selectors 154*a*, 154*b*, 154*c* such as, for example, three push buttons. Each selector 154*a*, 154*b*, 154*c* may be utilized to control different features or aspects of the operation of the controller 102. For example, a first selector 154*a* may be power button that is used to control whether controller 102 is in a powered, or "on" condition, or whether the controller 102 is in a power "off" condition. When in an "on" condition, the air pump or motor 108 may be operated to deliver air to the inflatable cushion device 104, when needed, so as to maintain a static air pressure in the interior region 112 at a target level.

According to the depicted embodiment, the controller 102 may also include a second selector 154*b* that is a push button that may be used to set the static air pressure level or range that the controller 102 is to at least attempt to attain/maintain in the interior region 112 of the inflatable cushion device 104. For example, according to certain embodiments, the controller 102 may be set to attain or maintain a first static air pressure in the interior region 112 of the inflatable cushion device 104. If the static air pressure in the interior region 112 is to be set at a level that is different than the first static pressure, a user or operator of the inflatable cushion device 104 may operably engage the second selector 154*b* such as, for example, by depressing the second selector 154*b*. Such engagement of the second selector 154*b* may increase or decrease the static pressure setting of the controller 102 from the set first static air pressure setting to a second, different set static air pressure setting. Further, the air pressure level at which the controller 102 is set and/or adjustments to the set static pressure level, may be visually indicated on the display 152 and/or detectable by an audible signal generated from the controller 102.

According to the depicted embodiment, the controller 102 may also include a third selector 154*c* that is a push button that may be used to control when operation of an air pump or motor 108 may be initiated. For example, according the illustrated embodiment, after the controller 102 has been placed in the power "on" condition by depressing of the first selector 154*a*, and the controller 102 has been set to maintain/attain a target static air pressure level, the third selector 154*c* may be operated so as to start operation of the air pump or motor 108. Activation of the third selector 154*c* may also change the operating mode of the controller 102 and/or air pump or motor from a standby mode to an automatic mode.

In addition to, or in lieu of, the one or more selectors 154, the controller 102 may also include a voice sensor 156 that may detect voice commands from a user or operator of the air delivery system 100. According to such an embodiment, the processing device 144 may have voice recognition capabilities that allow at least a portion of the operation of the controller 102 to be controlled by voice commands. Such components may include digital circuitry, analog circuitry, or a combination of both.

Additionally, the input/output devices 150 may also include an audible device 158 such as, for example, a speaker or other audible producing device, that may provide audible indications or alerts, including, for example, recognizable word(s), beeps, or other sounds, relating to the operation of the controller 102 and/or the condition of the inflatable cushion device 104. For example, according to certain embodiments, the audible device 158 may provide an audible indication of the static air pressure level at which the controller 102 is set to operate and/or indications of adjustments to the static air pressure level setting of the controller 102. Additionally, the processing device 144 may be adapted to instruct the audible device 158 to produce an audible alert when potential risks to, or malfunction in, the operation of the air delivery system 100 are detected, including, for example, when the set static air pressure for the controller 102 exceeds a maximum prescribed pressure for the inflatable cushion device 104, and/or when the set or sensed static air pressure level may cause the inflatable cushion device 104 to be insufficiently inflated or inflated to levels at which the inflatable cushion device 104 is too firm for the user. Additionally, the processing device 144 may also be adapted to instruct the audible device 158 to produce an audible alert when potential risks to the user of the device are detected such as, for example, when a change in the measured static pressure may indicate that the user has become disengaged with the inflatable cushion device 104 or the position of the user relative to the inflatable cushion device 104 has not changed, or changed at least a certain number of times, within a predetermined time period. For example, according to embodiments in which the inflatable cushion device 104 is an air mattress, the processing device 144 may instruct the audible device 158 to produce a sound when a change in the sensed static air pressure indicates that the user may have fallen off of the inflatable cushion device 104, or repeated sensed static air pressure levels over a certain time period indicates that the position of the body of the user is not changing on the inflatable cushion device 104 with the desired regularity.

Referencing FIG. 3, according to certain embodiments, the pressure sensor 142 may be included with the controller 102 and be operably connected to the processing device 144. A variety of different types. of sensors or gages may be used for the pressure sensor 142, including, for example, digital or analog gages. According to the depicted embodiment, the pressure sensor 142 may provide an indication of the static air pressure in the interior region 112 by detecting or otherwise measuring the static air pressure of air in the second inner passageway 132*b*. However, as previously mentioned, the pressure sensor 142 may be located in a number of different positions besides, or in addition to, the controller 102. For example, as previously mentioned, the pressure sensor 142 may be positioned on or in the inflatable cushion device 104, the discharge device 114, the supply conduit 106, and/or a gage line or tube that extends away from the discharge device 114 and into the interior region 112. Further, the pressure sensor 142 may be used to continuously, or relatively continuously, measure and/or record static air pressure. For example, according to certain embodiments, the pressure sensor 142 and/or the processing device 144 may be adapted to measure the static air pressure using the pressure sensor 142 in relatively short time intervals such as, for example, measuring static air pressure every 2, 4, 6, 8, or 10 seconds. However, the frequency of each measurement, or the delay, if any, between measurements, may vary. Further, according to certain embodiments, the controller 102, and more specifically the processing device 144, may be adapted such that the frequency of each static air pressure measurement may be adjustable by the operator or user.

By constantly measuring the static air pressure, the controller 102 may be adapted to limit operation of the air pump or motor 108 to instances in which the static air pressure is outside of a predetermined or targeted static air pressure range. Accordingly, while the controller 102 may continuously, or relatively continuously, sense or measure static air pressure, the controller 102 may only intermittently operate the air pump or motor 108. Thus, unlike other devices where an air pressure is maintained by leaking air from an inflatable device and continuously running an electrical pump to replace the leaked air, the inflatable cushion device 104 of the present invention may be configured to prevent air leaks, thereby allowing for air delivery system 100 to utilize the measuring of a static air pressure to operate the controller 102 and/or air pump or motor 108. Further, by not relying on the inflatable cushion device 104 to leak air as part of maintaining a pressure level within the inflatable cushion device 104, and instead utilize static air pressures, the inflatable cushion device 104 may reduce the risk of potential containments being leaked from the inflatable cushion device 104 that may adversely impact the health or condition of at least the user. Additionally, by utilizing an inflatable cushion device 104 adapted to prevent air leakage from the interior region 112 of the inflatable cushion device 104, the air delivery system 100 may minimize operation of the air pump or motor 108, thereby also minimizing the associated electricity costs. Wear on the air pump sensed or measured using the pressure sensor 142 may be tracked live and/or recorded such as, for example, continuously recorded in the memory 148. Further, the recorded static air pressure may be analyzed such as, for example, by the controller 102, or may be downloaded for analysis in other manners, including, for example, downloaded to an auxiliary device, including, but not limited to, processor based devices. For example, according to certain embodiments, the controller 102 may include a port and/or a transceiver that permits a wired or wireless connection of the controller 102 to an electronic device, and moreover, a connection that permits the transfer of live and/or recorded data relating to the sensed or measured static air pressures from the controller 102 to other devices such as, for example, a computer and/or portable communication device, which may, or may not, be remotely located. The recorded data relating to sensed static air pressures may be utilized for a variety of different purposes, including, for example, determining whether the position of the user relative to the inflatable cushion device 104 has been changing with any regularity or with a desired frequency.

According to certain embodiments, the controller 102 may also include, or be operably connected to, a pressure relief valve 160. As shown in the depicted embodiment, the pressure relief valve 160 may be operated by the processing device 144. According to certain embodiments, the processing device 144 may activate the pressure relief valve 160 based on the static air pressure level sensed or measured using the pressure sensor 142. For example, the processing device 144 may determine that the static air pressure, as measured using the pressure sensor 142, is approaching, has reached, or exceed~the maximum static air pressure level for the inflatable cushion device 104, or the is outside a comfort range for the user. In such a situation, the processing device 144 may generate an instruction that is used to open the pressure relief valve 160. According to other embodiments, the pressure relief valve 160 may be opened by the operator or user of the controller such as, for example, by operation of a selector 154. For example, the operator or user may engage a selector 154 to operate the pressure relief valve 160 so as to release air from the air delivery system 100, and thereby reduce the static air pressure level in the interior region 112 of the inflatable cushion device 104.

Additionally, according to certain embodiments, the system 100 may also include a mechanical pressure relief valve. For example, a spring-loaded pressure relief valve may be incorporated into the body of the controller 102, or extend from, or otherwise be coupled to, the supply conduit 106, such as by a coupling that connects the supply conduit 106 to the pump or motor 108, the inflatable cushion device 104, or to other segments or portions of the supply conduit 106. According to such embodiments, when air pressure within the supply conduit 108 and/or the inflatable cushion device 104 exceeds a predetermined pressure level, the air pressure may exert a sufficient force to overcome the biasing force of a spring element of the mechanical pressure relief valve, thereby causing the mechanical pressure relief valve to be adjusted from a closed condition to an open condition. Further, when the mechanical pressure relief valve is in the open condition, air may be released from the system 100 through the mechanical pressure relief valve, which thereby reduces the air pressure within the supply conduit 106 and/or the inflatable cushion device 104 until the air pressure therein is at a level that is unable to overcome the biasing force of the spring element. With the air pressure within the supply conduit 108 and/or the inflatable cushion device 104 being at a level that is insufficient to overcome the biasing force of the spring element of the mechanical pressure relief valve, the mechanical pressure relief valve may return from the open condition to the closed condition so as to discontinue the release of air from the system 100 through the mechanical pressure relief valve.

Figure 7:
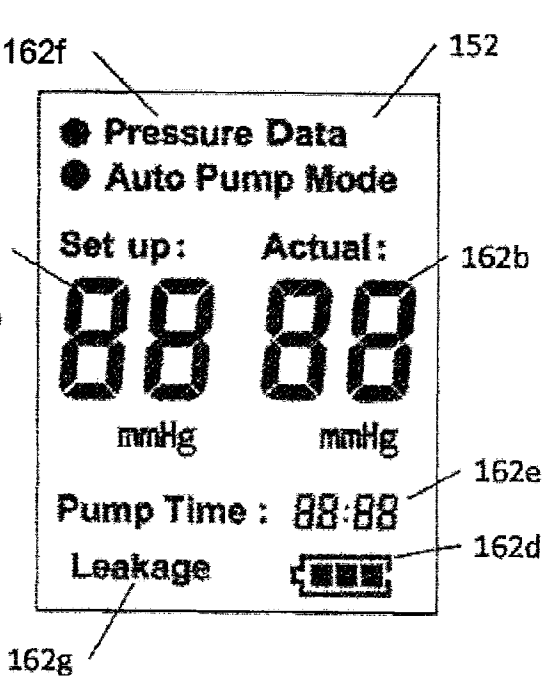
FIG. 7 illustrates a screen shot of an exemplary display according to an illustrated embodiment of the present invention.
Figure 5:
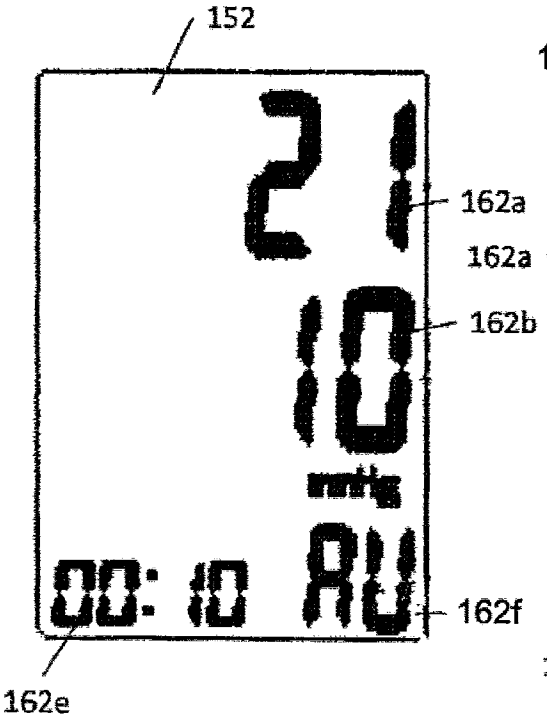
FIG. 5 illustrates a screen shot of the exemplary display shown in FIG. 4 during general operation of the controller.
Figure 4:
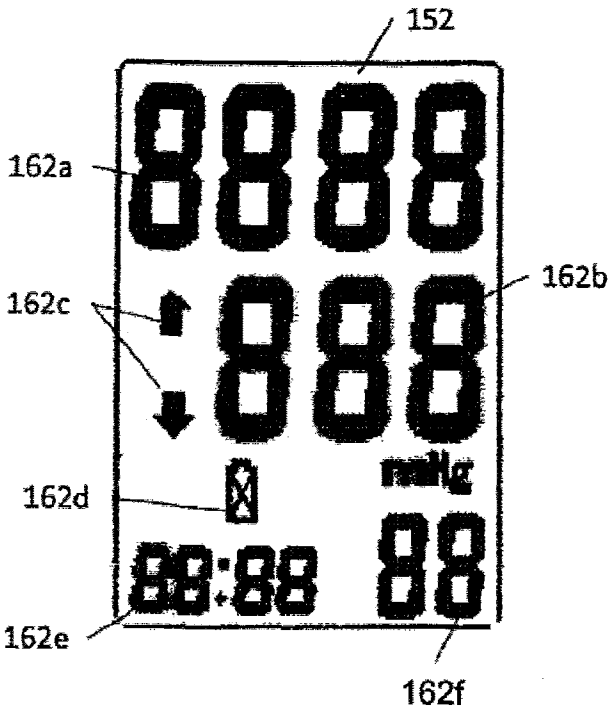
FIG. 4 illustrates an exemplary display for a controller according to an illustrated embodiment of the present invention.

FIGS. 4, 5 and 7 illustrate exemplary displays 152 for a controller 102 demonstrating different types of information that may be displayed on the display 152 during operation of the air delivery system 100. The particular information displayed by using the display 152, as well as the format and arrangement of such displayed information, may vary for different embodiments. According to the depicted embodiment, the display 152 may include a plurality of fields that display various types of information relating to the operation of the air delivery system 100, including operation and/or status of the controller 102, the air pump or motor 108, or the inflatable cushion device 104. For example, as shown, the display 152 may include a first field 162*a* that displays the set static air pressure, which may correspond to the static air pressure that the controller 102 is currently set to attain and/or maintain via operation of the air pump or motor 108. Further, a second field 162*b* may indicate the static air pressure level that is, or has been, sensed measured using the pressure sensor 142. For example, referencing FIG. 5, in the depicted example, the first field 162*a* indicates that the controller 102 has a set static air pressure level of 21 mmHg, while the second field 162*b* indicates that the static air pressure sensed or measured using the pressure sensor 142 is 10 mmHg. The units of measurement, if any, associated with the pressure level such as, for example, "mmHg," "kPa," or "PSI," may or may not be displayed with, or in proximity to, either or both of the set and sensed static air pressures.

The display 152 may also include a third field 162*c* that indicates whether operation of the second selector 154*b* will be increasing or decreasing the set static air pressure level that is shown in the first field 162*a*. For example, in the illustrated embodiment, the third field 162*c* may provide graphical illustrations of arrows that indicate whether engagement of the third selector 154*c* will result in increasing or decreasing the set static air pressure level of the controller 102.

According to certain embodiments in which the controller 102 is configured to include a power supply source, such as a battery, the display 152 may include a fourth field 162*d* that provides an indication of the presence and/or condition of the power supply source. For example according to certain embodiments, the fourth field 162*d* may provide an indication of the power level remaining in the power supply source.

A fifth field 162*e* of the display 152 may provide a timer such as, for example, a timer that provides an indication of duration of time that the air pump or motor 108 has been in operation. However, the fifth field 162*e* in the present example may provide an indication of other time periods, including, for example, the duration of time that the air pump or motor 108 has been in an automatic or standby mode, or a countdown of time remaining before the air pump or motor 108 or the pressure relief valve 160 is going to be activated to adjust the static air pressure in the interior region 112 of the inflatable cushion device 104, among an indication time relating to other events.

The display 152 may also include a sixth field 162*f* that indicates the operating or running mode of the air pump or motor 108. For example, in the depicted embodiment, the operating or running mode of the air pump or motor 108 may be adjusted by engagement of the third selector 154*c* such as, for example, when the user initiates operation of the air pump or motor 108 after setting the static air pressure level for the controller 102, A variety of different pump operating modes may be indicated by the sixth field 162*f*, including, for example, an indicator that the air pump or motor 108 is being operated in an automatic mode (including, but not limited to, "AU" or "Auto Pump Mode") or in a standby mode (including, but not limited to, "Press Meter Mode" or "Standby Mode"). When in the automatic operating mode, the air pump or motor 108 may be automatically operated when the sensed static air pressure is outside of the set static air pressure level or range. However, the response time between detection of the sensed static air pressure being outside of the set static air pressure level or range and operation of the air pump or motor 108 for delivery of air to the inflatable cushion device 104 may vary. For example, according to certain embodiments, the air pump or motor 108 may not be operated for a predetermined time period after the detection of differences between the sensed and set static air pressure levels. Such a delay may allow for the controller 102 to determine if such differences between the sensed and set static air pressure levels is temporary in nature such as, for example, due to changes in positioning of the user relative to the inflatable cushion device 104. For example, the sensed static air pressure level may drop during periods in which the user has temporarily removed himself/herself from certain inflatable cushion devices 104 such as, for example, when the inflatable cushion device 104 is an air mattress. In such a situation, if the air pump or motor 108 or pressure relief valve 160 were operated within a relatively short time period after detection of the decrease in sensed static air pressure, then, when the user returned to operably reengages, or otherwise settles in a position on, the inflatable cushion device 104, the static air pressure may be either too high or too low, which may cause the static air pressure level to exceed the capacity of the inflatable cushion device 104, result in insufficient inflation of the inflatable cushion device 104, and/or result in discomfort of the user.

The display 152 may also include a sixth field 162*g* that indicates an air leakage from one or more components of the air delivery system 100. The leakage indicator 162*g* may also be combined with an audible alert via device 158 to indicate an air leakage from one or more components of the air delivery system 100. The controller 102 may be used to activate the visual leakage indicator 162*g* and audible leakage indicator 158 when the air pump or motor 108 has remained powered for an extended period of time such as, for example, 25 minutes. Additionally, according to certain embodiments, the visual leakage alarm 162*g* and audible leakage alarm 158 may be reset to an unpowered condition by pressing the first selector 154*a* on the controller 102.

The displays 152 depicted in FIGS. 4, 5 and 7 show exemplary fields according to a certain embodiments of the controller 102. However, according to other embodiments, one or more of the fields 162*a-g* illustrated in FIGS. 4, 5 and 7 may be replaced by other fields or removed from the display 152. Further, each display 152 may be adapted to display a variety of different types of information, including, for example, the heart rate of the user. Additionally, according to embodiments in which the controller 102 is used to control and/or monitor the inflation and/or static pressure level of multiple inflatable cushion devices 104, the display 152 may include a field that indicates which particular inflatable cushion devices 104 or user is associated with particular displayed set or sensed static air pressure levels. For example, according to certain embodiments, the display 152 may include a field that indicates that other information displayed on the display 152 is associated with a first inflatable cushion device or user, or whether the displayed information is associated with a second inflatable cushion device or second user. Further, certain information displayed on the display 152 such as, for example, set or sensed static pressure levels, heart indicators, or battery power indicators, among other information, may be graphically represented, including, for example, by the display of color gages. Additionally, the controller 102 may be adapted to include a display timeout function in which the display 152 does not display the one or more of the fields after a predetermined time period of inactivity such as, for example, after the controller 102 has not received any indication of a static air pressure being sensed by the pressure sensor 142 or not detected activity involving the one or more of the selectors 154 over the course of a predetermined time period.

Figure 6:
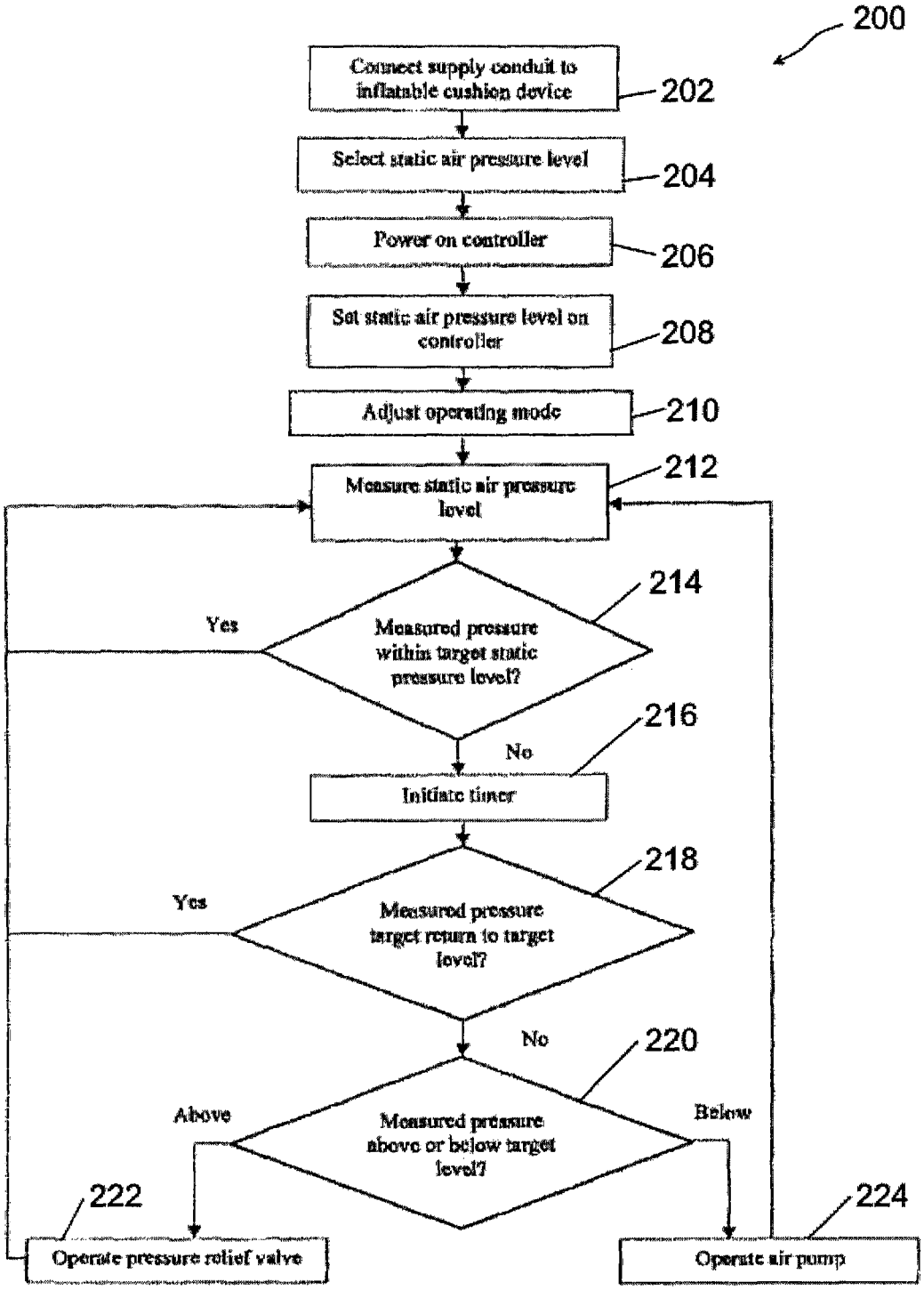
FIG. 6 illustrates a schematic flow diagram of an exemplary process for operation of the air delivery system so that the air pump or motor is discontinuously or intermittently operated while the static air pressure is relatively continuously measured.

FIG. 6 illustrates a schematic flow diagram of an exemplary process 200 for operation of the air delivery system 100 so that the air pump or motor 108 is discontinuously or intermittently operated while the static air pressure in the interior region 112 of the inflatable cushion device 104 is relatively continuously measured. Operations illustrated for all of the processes in the present application are understood to be examples only, and operations may be combined or divided, and added or removed, as well as re-ordered in whole or in part, unless explicitly stated to the contrary.

At step 202, the supply conduit 106 may be operably secured to the discharge device 114 and the controller 102 so that at least air provided by operation of the air pump or motor 108 may be, if needed, delivered through the supply conduit 106 to the discharge device 114, and thus into the interior region 112. According to certain embodiments, the inflatable cushion device 104 maybe in an inflated or deflated condition before the supply conduit 106 is secured to the discharge device 114. Additionally, as previously discussed, connecting the supply conduit 106 to the controller 102 and the discharge device 114 may allow the pressure sensor 142 to detect a static air pressure indicative of the static air pressure within the interior region 112 of the inflatable cushion device 104.

At step 204, a target static air pressure for the patient may be selected. For example, according to certain embodiments, the operator or user of the air delivery system 100 may reference a guide or chart related to the application of the inflatable cushion device 104, certain characteristics of the user, and/or a condition(s) of the user to determine a target static air pressure level or range that is to be maintained in the interior region 112 of the inflatable cushion device 104. For example, according to embodiments in which the inflatable cushion device 104 is an inflatable mattress, the target static air pressure level that is to be at least attempted to be maintained in the interior region 112 may be based on one or more characteristics of the user and/or the pressure limits of the inflatable cushion device 104. Such user characteristics may be based on a variety of different factors, such as, for example; a height, weight, or ratio thereof of the user, a static air pressure level that provides appropriate air suspension for the user or body part of the user, which may, in at least certain situations, be based on a hand check performed by a caregiver under the bony prominences of the user, and/or by an indication from a pressure mapping device of a pressure level on a surface adjacent to the inflatable cushion device 104 when the user is operably positioned on the inflatable cushion device 104. According to certain embodiments in which the inflatable cushion device 104 is an air mattress, the target static air pressure level may generally be approximately 18 mmHg to approximately 38 mmHg. However, the target static air pressure level selected at step 204 may also be adjusted for a variety of different reasons, including based on user comfort preferences, among other reasons.

At step 206, the controller 102 may be placed in the power "on" condition. For example, according to the depicted embodiment, if the controller 102 is in the powered "off" condition, an operator and/or user of the controller 102 may depress the first selector 154*a* to place the controller 102 in the power "on" condition. At step 208, a static air pressure level may be set for the controller 102 (also referred to as the set static air pressure level or range), which may be based on the target static air pressure that was selected at step 204 and/or user comfort preferences. For example, at step 208, if static air pressure that the controller 102 is currently set to attain and/or maintain in the interior region 112 is outside of the target static air pressure level, the controller 102 may be adjusted so that the controller 102 is set to attain/maintain a static air pressure that is at, or within, the target static air pressure level or range. According to the depicted embodiment, the static air pressure level settings on the controller 102 may be adjusted to the set static air pressure level of the controller 102 by engagement with the second selector 154*b*.

According to certain embodiments, if operation of the air pump or motor 108 is in the standby mode, then at step 210, the controller 102 may be engaged so that operation of the air pump or motor 108 is in the automatic mode. At step 212, using the pressure sensor 142, the controller 102 may measure or sense a static air pressure that corresponds to the static air pressure in the interior region 112 of the inflatable cushion device 104. According to certain embodiments, the sensed static air pressure may be remotely observed by the caregiver live and/or stored or recorded by the controller 102 such as, for example, in the memory 148 of the controller 102. Further, as previously discussed, the controller 102 may continuously measure the static air pressure level, even when the controller 102 is performing other operations that may adjust the static air pressure level in at least the interior region 112 of the inflatable cushion device 104.

At step 214, the controller 102 may determine whether the measured static air pressure is within the set static air pressure level or range that was set on the controller 102 at step 208. If the measured static air pressure level is outside the target static air pressure level, then, according to certain embodiments, at step 216, the controller 102 may initiate activation of a timer. The timer may delay when the controller 102 may be operated in manner that will adjust the static air pressure in the interior region 112 of the inflatable cushion device 104. Such a delay may account for changes in the operation or use of the inflatable cushion device 104 that may cause the measured static air pressure to be outside the target static air pressure set level or range such as, for example, changes in the position of the user's body relative to the inflatable cushion device 104. The duration of the delay may vary and may, for example, extend from seconds to minutes in duration. However, according to certain embodiments, the delay may be overridden or relatively short in certain situations such as, for example, when the sensed or measured static air pressure level is elevated to a level beyond the capacity of the inflatable cushion device 104 or which may result in rupture or other damage to the inflatable cushion device 104. Further, during the delay, the controller 102 may continue to relatively continuously measure the static air pressure.

At step 218, the controller 102 may inquire as to whether the static air pressure measured during the delay indicates that the static air pressure within the interior region 112 has returned to being within the set or target static air pressure level or range. If the controller 102 determines that static air pressure level measured during the delay returned to the set or target static air pressure level or range, then the controller 102 may decide not to be operated in a manner that adjusts the static air pressure within the interior region 112.

If at step 218 the controller 102 determined that the static air pressure measured during the delay was outside the set or target static air pressure level or range, then at step 220, the controller 102 may determine whether the static air pressure is above or below the set or target static air pressure level or range. If the controller 102 determines that the measured static air pressure is above the set or target static air pressure range or levels then, at step 222, the controller 102 may operate the pressure relief valve 160 to release air from the air delivery system 100, and thereby decrease the static air pressure level in the interior region 112 of the inflatable cushion device 104. According to certain embodiments, the controller 102 may continue to relatively continuously measure static air pressure corresponding to the static air pressure level in the interior region 112 as the pressure relief valve 160 is operated, which may thereby provide the controller 102 with an indication as to when to cease releasing air from the air delivery system 100. According to other embodiments, the controller 102 may determine a quantity of air to release from the air delivery system 100 based on the difference in the measured static air pressure and the set or target static air pressure Level or ranges, and utilize that difference to determine a quantity of air that is to be released from the air delivery system 100 via operation of the pressure release valve 160. According to such embodiments, the pressure relief valve may be operated for a period of time that is predicted to allow the release of a quantity of air from the air delivery system 100 that allows the static air pressure level in the interior region 112 to be reduced to a level that is within the set or target static air pressure level or range.

However, if at step 220 the controller 102 determines that the measured static air pressure is below the set or target static air pressure range or levels then, at step 224, the controller 102 may operate the air pump or motor 108 to deliver a flow of air via the supply conduit 106 for the interior region 112 of the inflatable cushion device 104 that may increase the static air pressure level in the interior region 112. The rate of delivery of air via operation of the air pump or motor 108 may vary. For example, according to certain embodiments, the rate of delivery may be based on the degree to which the measured static air pressure is below the set or target static air pressure level or range. For example, according to certain embodiments, the airflow rate may be relatively fast in instances in which the difference between the measured and set static air pressure levels are relatively large such as, for example, when the inflatable cushion device 104 is in an uninflated condition. However, the rate of delivery of air may slow when the difference between the measure and set or target static air pressure levels are relatively small, and thereby cause a gradual change for the patient. Further, according to certain embodiments, the controller 102 may continue to relatively continuously measure static air pressure corresponding to the static air pressure level, in the interior region 112 as the air pump or motor 108 is operated, which may thereby provide the controller 102 with an indication as to when to cease supplying air for the interior region 112. According to other embodiments, the controller 102 may determine a quantity of air to deliver to the interior region 112 based on the difference in the measured static air pressure and the set static air pressure level or ranges.

Various features and advantages of the present invention are set forth in the following claims. Additionally, changes and modifications to the embodiments described herein will be apparent to those skilled in the art, and such changes and modifications can be made without departing from the spirit and scope of the present invention and without diminishing its intended advantages. While the present invention has been illustrated and described in detail in the drawings and foregoing description, the same is to be considered illustrative and not restrictive in character, it being understood that only selected embodiments have been shown and described and that all changes, equivalents, and modifications that come within the scope of the inventions described herein or defined by the following claims are desired to be protected.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A method for maintaining a static air pressure level within an interior region of an inflatable cushion device, the method comprising:

selecting a target static pressure level based on at least one physical characteristic of a user of the inflatable cushion device;

setting a controller to operate an air pump to attain the selected target static air pressure level in the interior region of the inflatable cushion device;

measuring, relatively continuously and while the inflatable cushion device is positioned about or beneath at least a portion of the user, a static air pressure that indicates the static air pressure level within the interior region;

activating, by the controller, operation of the air pump to supply an airflow from the air pump for the interior region in response to measured static air pressure being below the selected target static air pressure level;

deactivating, by the controller, operation of the air pump when measured static air pressure is not below the selected target static air pressure level;

delivering the supply of airflow from the air pump to the inflatable cushion device via a first inner passageway of a supply conduit; and activating a pressure relief valve to release an amount of air from the interior region in response to the static pressure exceeding a spring force of the pressure relief valve;

wherein the step of measuring a static air pressure comprises measuring the static air pressure of air contained in a second inner passageway of the supply conduit, the second inner passageway being in fluid communication with the interior region of the inflatable cushion device.

2. The method of claim 1, wherein the at least one physical characteristic is at least one of the following: a user weight, a user height, a ratio of user weight and height, or a user comfort preference.

3. The method of claim 1, further including the step of determining, by the controller, whether the measured static air pressure is above or below the selected target static air pressure level.

4. The method of claim 1, further including the step of operating, by the controller, the pressure relief valve to reduce the static air pressure level in the interior region in response to the controller determining measured static air pressure is above the selected target static air pressure level.

5. The method of claim 1, wherein the step of measuring, relatively continuously, the static air pressure comprises measuring static air pressure within approximately every 10 seconds when the air pump is in an automatic operating mode.

6. The method of claim 1, further including the step of delaying, for a predetermined time period, activating operation of the air pump when the measured static air pressure is below the selected target static air pressure level.

7. The method of claim 1, further including the step of selecting, by operation of a selector of the controller, an operating mode for the operation of the air pump, the operating mode available for selection including at least one of the following: an automatic operating mode or a standby operating mode.

8. The method of claim 1, wherein the inflatable cushion device is an inflatable air mattress.

9. A method for maintaining a static air pressure level in an interior region of an inflatable cushion device, the method comprising:

measuring, relatively continuously and while the inflatable cushion device is positioned about or underneath at least portion of a user, a static air pressure that corresponds to the static air pressure level in the interior region;

determining, by a controller having a processing device, whether the measured static air pressure is above or below a target static air pressure level;

delaying, for a predetermined time period, activation of an air pump when the measured static air pressure is below the target static air pressure level, the air pump adapted to provide a supply of airflow for delivery to the interior region;

determining, by the controller, whether static air pressure measured during the predetermined time period is within the target static air pressure level;

activating, by the controller and upon expiration of the predetermined time period, the air pump if the static air pressure measured during the predetermined time period remained below the target static air pressure level;

maintaining, by the controller, the air pump in a deactivated mode when measured static air pressure is within the target static air pressure level; and delivering the supply of airflow from the air pump to the inflatable cushion device via a first inner passageway of a supply conduit, wherein the step of measuring a static air pressure comprises the measuring static air pressure of air contained in a second inner passageway of the supply conduit, the second inner passageway being in fluid communication with the interior region of the inflatable cushion device.

10. The method of claim 9, wherein the inflatable cushion device is an inflatable air mattress.

11. The method of claim 9, further including the step of selecting the target static air pressure level, the selected target static air pressure being based at least in part on at least one of the following: a weight to height ratio of the user; a pressure level that provides air suspension to offload at least a portion of the body of the user; a pressure indication from a pressure mapping device.

12. The method of claim 9, further including the step of operating, by the controller, a pressure relief valve to reduce the static air pressure level in the interior region in response to the controller determining measured static air pressure is above the selected target static air pressure level.

13. The method of claim 9, wherein the step of measuring, relatively continuously, static air pressure comprises measuring static air pressure within approximately every 10 seconds when the air pump is in an automatic operating mode.

14. The method of claim 9, further including the step of selecting, by operation of a selector of the controller, an operating mode for the operation of the air pump, the operating modes available for selection including at least one of the following: the automatic operating mode or a standby operating mode.

15. An air delivery system comprising:

an inflatable cushion device adapted to support at least a portion of a body of a user;

a supply conduit having a first end, a second end, a first inner passageway, and a second inner passageway, the second end operably connected to the inflatable cushion device, the first and second inner passageways being in fluid communication with an interior region of the inflatable cushion device; and a controller having a pressure sensor and an air pump, the first end of the supply conduit being operably connected to the controller, the first inner passageway being in fluid communication with the air pump, the second inner passageway being in fluid communication with the pressure sensor, wherein the controller is adapted to, through use of the pressure sensor when the inflatable cushion device is operably positioned to support at least a portion of the user, relatively continuously measure a static air pressure of air received in the second inner passageway from the interior region, wherein the controller is further adapted to activate the air pump to supply an airflow through the first inner passageway of the supply conduit for the interior region of the inflatable cushion device when the static air pressure measured by the controller is below a target static air pressure level, and wherein the controller is adapted to deactivate operation of the air pump when the static air pressure measured by the controller is within the target static air pressure level.

16. The air delivery system of claim 15, wherein the inflatable cushion device further includes a discharge device having a body portion and a gage line, a connection member of the body portion adapted to be operably connected to the second end of the supply conduit, a discharge outlet in the body portion adapted to receive the supply of airflow from the first inner passageway, the gage line being in fluid communication with the second inner passageway, a gage inlet of the gage line adapted to provide an opening for the flow of air between the gage line and the interior region, the gage inlet positioned at a remote location from the body portion.

17. The air delivery system of claim 16, wherein the inflatable cushion device is an air mattress, and wherein the controller further includes a display, at least one selector, an audible device, and a voice sensor.

18. The air delivery system of claim 17, wherein the controller is adapted to delay the activation of the air pump for a predetermined period of time after a static air pressure measured by the controller is below the target static air pressure level.

* * * * *